US006598581B2

(12) United States Patent
Kempf

(10) Patent No.: US 6,598,581 B2
(45) Date of Patent: Jul. 29, 2003

(54) METALLIC COATING ON A COMPONENT OF AN INTERNAL COMBUSTION ENGINE

(75) Inventor: James John Kempf, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/022,748

(22) Filed: Dec. 13, 2001

(65) Prior Publication Data

US 2003/0111038 A1 Jun. 19, 2003

(51) Int. Cl.[7] ..... F02M 35/12

(52) U.S. Cl. ..... 123/198 E; 123/184.61; 29/890.08

(58) Field of Search ..... 123/198 E, 184.61, 123/184.53; 181/183, 198, 204, 214, 222, 229, 240, 252, 256, 296; 29/890.08

(56) References Cited

U.S. PATENT DOCUMENTS

| | | | | | |
|---|---|---|---|---|---|
| 3,734,139 | A | * | 5/1973 | Zafiroglu | 138/146 |
| 4,350,223 | A | * | 9/1982 | Takei | 181/229 |
| 4,407,528 | A | * | 10/1983 | Anthony | 285/50 |
| 4,432,433 | A | | 2/1984 | Ogawa | |
| 4,522,165 | A | * | 6/1985 | Ogawa | 123/195 C |
| 4,743,481 | A | * | 5/1988 | Quinlan et al. | 428/35.7 |
| 4,851,271 | A | | 7/1989 | Moore, III et al. | |
| 4,903,645 | A | | 2/1990 | Borger | |
| 5,003,933 | A | * | 4/1991 | Rush et al. | 123/184.42 |
| 5,025,888 | A | * | 6/1991 | Arcas et al. | 181/213 |
| 5,038,725 | A | * | 8/1991 | Okazaki et al. | 123/184.61 |
| 5,150,669 | A | * | 9/1992 | Rush et al. | 123/184.42 |
| 5,186,500 | A | * | 2/1993 | Folkers | 285/55 |
| 5,243,933 | A | | 9/1993 | Mukawa | |
| 5,272,285 | A | * | 12/1993 | Miller | 181/202 |
| 5,530,213 | A | | 6/1996 | Hartsock et al. | |
| 5,620,549 | A | * | 4/1997 | Miyajima | 156/245 |
| 5,693,284 | A | * | 12/1997 | Mukawa | 264/513 |
| 5,699,835 | A | * | 12/1997 | Nakagawa et al. | 138/141 |
| 5,851,456 | A | * | 12/1998 | Mukawa et al. | 264/40.1 |
| 5,896,838 | A | * | 4/1999 | Pontopiddan et al. | 123/184.47 |
| 5,964,194 | A | * | 10/1999 | Pontopiddan et al. | 123/184.42 |
| 6,085,709 | A | * | 7/2000 | Freese, V | 123/90.38 |
| 6,116,206 | A | | 9/2000 | Krentz | |
| 6,325,053 | B1 | | 12/2001 | Zappador et al. | |
| 6,475,424 | B1 | * | 11/2002 | van Manen | 264/513 |
| 2001/0047790 | A1 | | 12/2001 | Karlsson | |
| 2001/0047797 | A1 | | 12/2001 | Takano et al. | |
| 2002/0020383 | A1 | * | 2/2002 | Nakano et al. | 123/184.61 |
| 2003/0062013 | A1 | * | 4/2003 | Kino et al. | 123/184.53 |

FOREIGN PATENT DOCUMENTS

| | | | | |
|---|---|---|---|---|
| AT | WO200183842 | * | 11/2001 | C23C/4/06 |
| DE | 4216816 A | | 11/1993 | |
| DE | 10026355 A | | 1/2002 | |
| EP | WO 93/19291 A | | 9/1993 | |
| JP | 10-281025 | * | 10/1998 | F02M/35/10 |

* cited by examiner

*Primary Examiner*—Willis R. Wolfe
*Assistant Examiner*—Hai Huynh
(74) *Attorney, Agent, or Firm*—Brinks Hofer Gilson & Lione

(57) ABSTRACT

The present invention relates to a component for an internal combustion engine of an automobile having reduced NVH properties. The component has a shell formed with a plastic composite material. The shell defines an inlet port, an outlet port, an outer surface and an inner surface. The inner surface defines an inner cavity to allow air passage to the internal combustion engine. A damping layer is disposed on the outer surface such that damping layer substantially dampens the noise emitted from the component.

20 Claims, 4 Drawing Sheets

METALLIC COATING ON A COMPONENT OF AN INTERNAL COMBUSTION ENGINE

TECHNICAL FIELD OF THE INVENTION

This invention generally relates to an intake manifold of an internal combustion engine of a motor vehicle. More specifically, this invention relates to reducing noise in an intake manifold of an internal combustion engine.

BACKGROUND OF THE INVENTION

Noise is generated by the internal combustion engines due to engine vibration, internal pressure pulsations, and combustion. Intake manifolds have a distinct and profound affect on the Noise Vibration and Harshness (NVH) quality of the vehicle. This is because the intake manifolds are excited not only by the vibrational input of the structure of the engine but they are also excited by internal pressure pulsations due to intake events. Therefore, there is a need to design a manifold that is structurally sound to resist an extremely wide frequency range of forcing inputs.

In order to suppress undesirable noise from the intake manifold, prior art techniques have taught the use of an intake manifold cover. The cover is mechanically attached, sometimes with isolating features, to the intake manifold or engine. However, it has been found that the use of the NVH cover does not always result in effective reduction of noise from the manifold. Also, it has been found that due to packaging requirements the cover may not completely cover the intake manifold thereby allowing noise to escape.

Additionally, it has been found that aluminum intake manifolds have superior NVH qualities to that of plastic intake manifolds. This is due to their greater mass, which increases transmission loss through the part, and due to the increased stiffness of the part, which allows the manifold to resist deflection. Therefore, it is found that composite intake manifolds do not prevent noise transmission from their surfaces to maintain levels of radiated noise as low as possible.

Therefore, there is a need in the industry to manufacture intake manifolds that maintain low levels of NVH, are lightweight, easy to manufacture and cost effective.

SUMMARY OF THE INVENTION

The present invention generally relates to a component for an internal combustion engine of an automobile having reduced NVH properties. The component has a shell formed of a plastic composite material. The shell defines an inlet port, an outlet port, an outer surface and an inner surface. The inner surface defines an inner cavity to allow air passage to the internal combustion engine. In addition the component includes a damping layer disposed on the outer surface, where the damping layer substantially dampens the noise emitted from the component.

BRIEF DESCRIPTION OF THE DRAWINGS

Further features and advantages of the invention will become apparent from the following discussion and the accompanying drawings in which.

DETAILED DESCRIPTION OF THE INVENTION

The following description of the preferred embodiment is merely exemplary in nature and is in no way intended to limit the invention or its application or uses.

Figure 1:
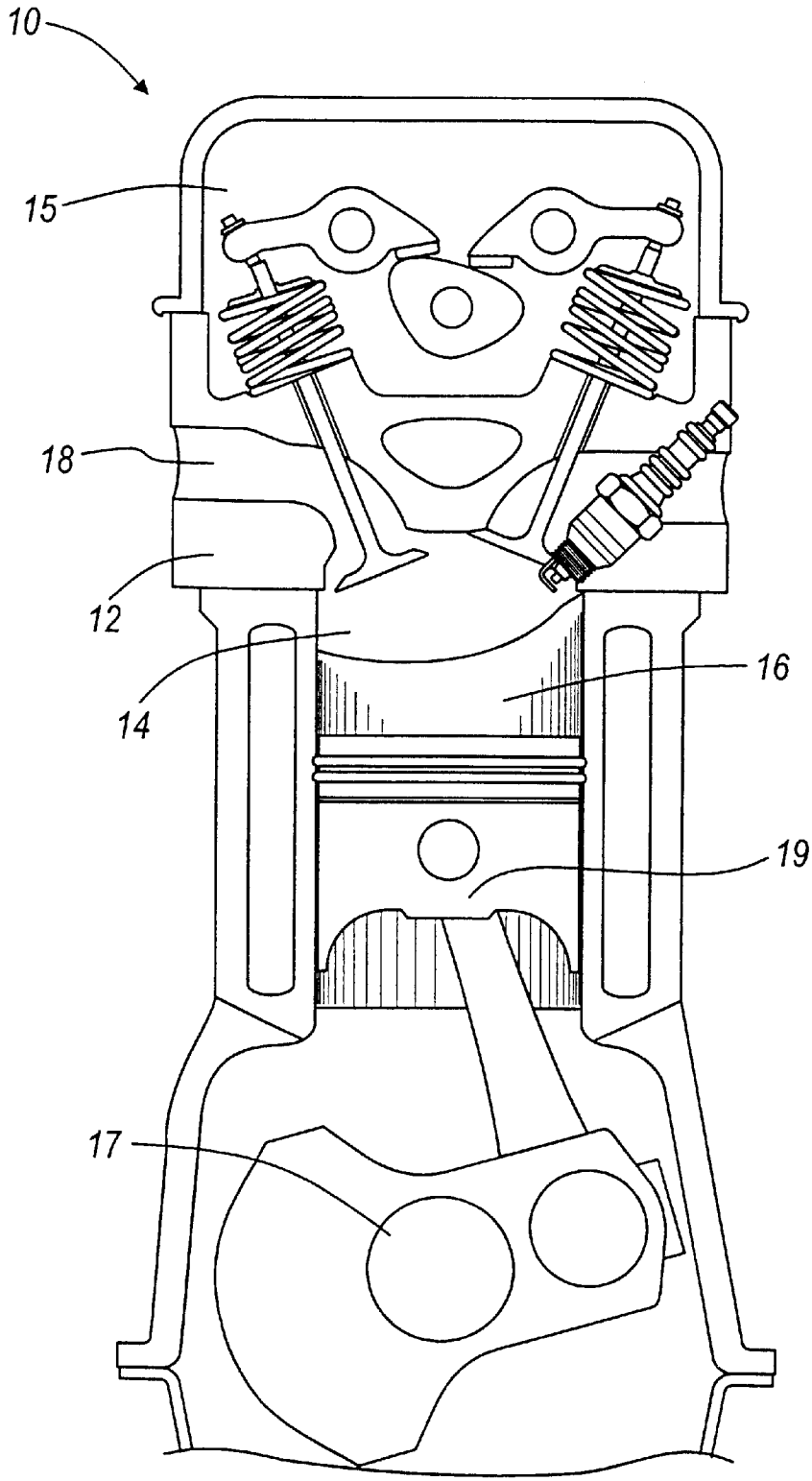
FIG. 1 is a perspective view of an internal combustion engine.

Referring in particular to FIG. 1, an internal combustion engine installed in a motor vehicle is generally shown and illustrated by reference numeral 10. As shown in FIG. 1, the engine 10 comprises a cylinder head 12, a combustion chamber 14 for burning the fuel, a piston 16 moving up and down inside the cylinder, a crankshaft 17 for moving the piston 16 in a circular motion, a connecting rod 19 connecting the piston 16 to the crankshaft 17, an intake port 18 for conduct air-fuel mixture to the crankshaft 17 and an valve 15 for selectively allowing air-fuel mixture to enter the combustion chamber 14. The engine 10 may have additional components such as oil pan, bearings, sparkplug, exhaust port, exhaust valve etc. The working of the engine 10 is well known and is not explained in details.

Figure 2:
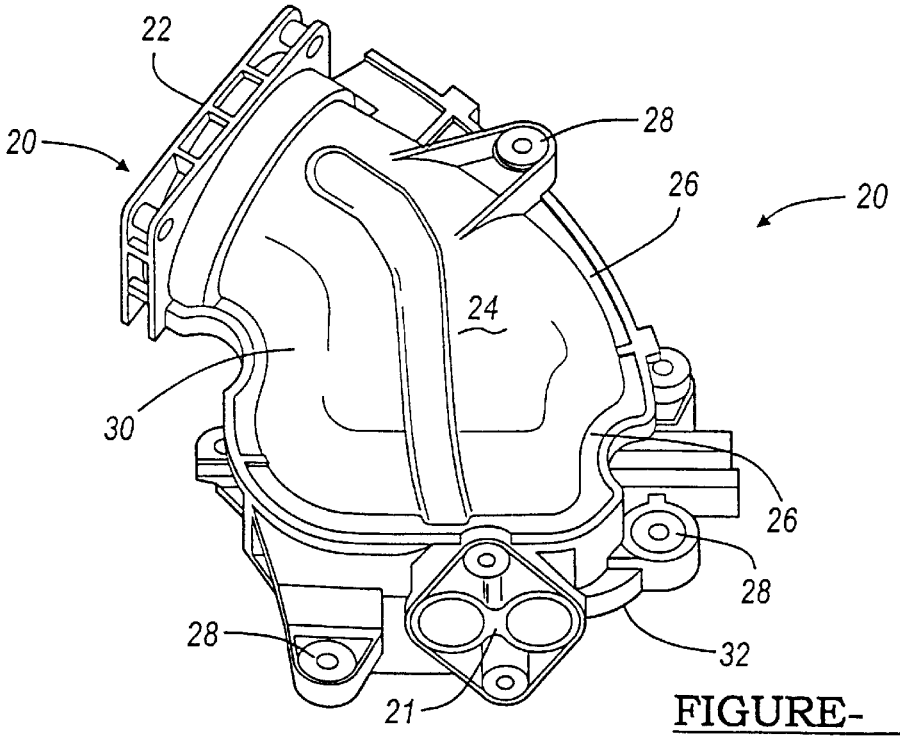
FIG. 2 is a perspective view of the throttle adapter of an intake manifold for an internal combustion engine.

The intake port 18 is connected to a conduit (not shown) that transports the air to the combustion chamber 14. The conduit at the other end is connected to an intake manifold (not shown). As shown in FIG. 2, a component of the intake manifold is shown and represented by reference numeral 20. The component 20 may be referred to as a throttle body adapter. The component 20 as shown is juxtaposed between the intake manifold and the throttle chamber (not shown). The component 20 includes an input port 21 connected to the throttle chamber and an output port 22 connected to the intake manifold. The component 20 has an inner surface (not shown) defining an interior cavity to allow air to pass to the combustion chamber 14 of the engine 10. The component 20 also defines an exterior surface 24. The component 20 further includes a flange 26 about the perimeter of the component 20. The flange 26 includes apertures 28 for receiving fasteners that secure the component 20 to the intake manifold or alternatively to the cylinder head 12.

Although in the drawings a component 20 of an intake manifold is generally shown and described, it must be understood that this invention is not limited to this component. The present invention may alternatively be used on other engine components such as an exhaust manifold or to non-engine mounted components.

Figure 4:
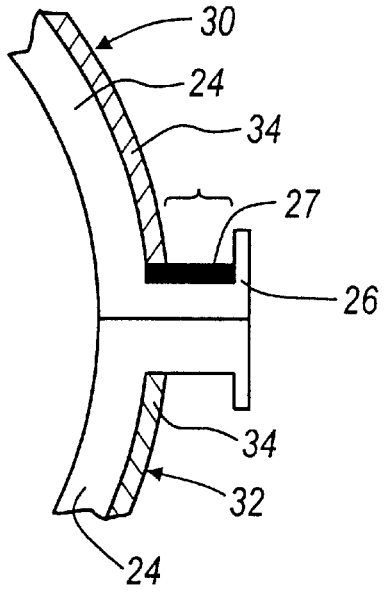
FIG. 4 is a cross sectional view of the component.

The component 20 is formed of two separate sections, a first section or an upper part 30 and a second section or a lower part 32 (shown in FIG. 4). Preferably, the first section 30 and the second section 32 are injection molded plastic shells. The first section 30 and the second section 32 are preferably welded together using vibration welding technique. Other joining techniques may also be used to join the first section 30 and the second section 32. Alternatively, the component 20 may be formed as a single integral piece. Preferably, the component 20 is formed of a plastic composite material. Preferably, the plastic composite material is selected from Nylon 6, 30% glass filled, Nylon 6, 33% glass filled, Nylon 6,6, 30% glass filled, Nylon 6,6, 33% glass filled or Nylon 6, 6, 35% glass filled. Alternatively, other composite material may be used.

Figure 3:
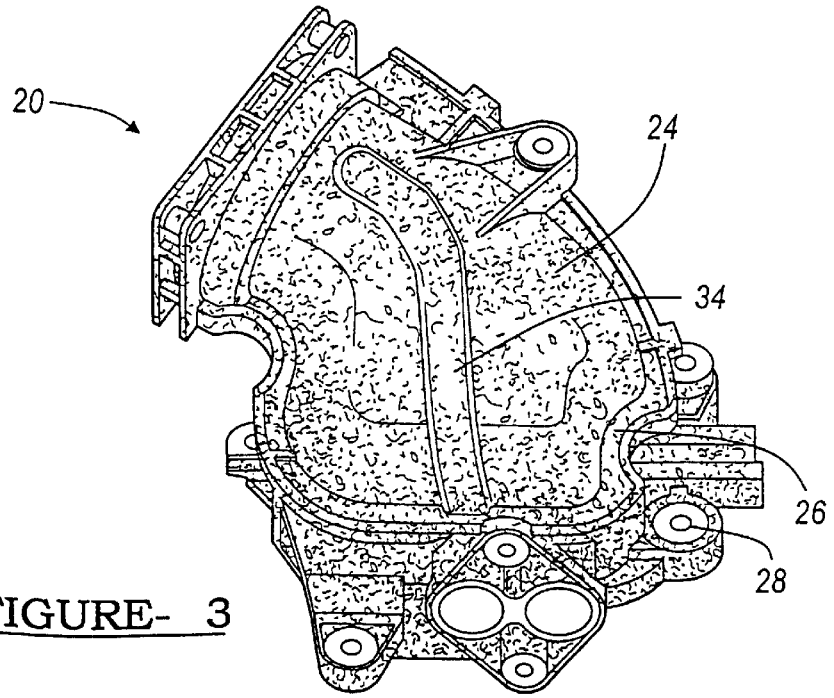
FIG. 3 is a perspective view of the throttle adapter with the damping layer of a metallic matrix for an internal combustion engine.

As shown in FIG. 3, in order to damp the noise emitted from the component 20, the exterior surface 24 is coated with a damping layer 34. The damping layer 34 is applied uniformly on to the exterior surface 24 of the component. Preferably, the both the exterior surface 24 of the first section 30 and the second section 32 is coated with the damping layer 34. As the name suggests the damping layer 34 will substantially dampen noise emitted from the component 20.

Referring to FIG. 4, the damping layer 34 is selectively applied to the exterior surface 24 such that certain surfaces of the exterior surface 24 are free of the damping layer 34. In order to selectively apply the damping layer 34 to the exterior surface 24, portions of the exterior surface 24 are covered with a mask 27. The mask 27 is a reusable shielding material that prevents the damping layer 34 from being applied in the desired area. It is preferred that the flange 26 and the apertures 28 are covered by the mask 27 before the damping layer 34 is applied on the exterior surface 24 of the component 20.

The damping layer 34 is preferably applied using the thermal spray casting process. Briefly described, this process, is simply a manufacturing process of applying a coat or coatings of material to a substrate to impart properties unobtainable by base material selections alone. The process includes heating the desired coating material used to form the damping layer 34 until it becomes molten. The atomized molten metal particles, preferably having a diameter of 0.1 mm to 0.4 mm are then carried through the air by air pressure or other means. The airborne particles hit the exterior surface 24 of the component 20 and rigorously bond the material to the exterior surface 24. Bonding of the thermally sprayed coatings is principally through mechanical interlocking between the atomized particles and the exterior surface 24. Generally, when applying metals to engineering thermoplastics, the plastic, in this case the exterior surface 24 is melted and re-crystallizes with an aggressive mechanical bond.

The damping layer 34 is preferably a metallic coating where the metal is selected from a group consisting of zinc or aluminum. Preferably, the exterior surface 24 of the first section 30 and the second section 32 is covered with the damping layer 34 formed of the same metal. Alternatively, damping layer formed of different metal may be applied to the exterior surface 24 of the first section 30 and the second section 32. Preferably, the metal used does not have a high molten temperature such that excessive deformation occurs to the exterior surface 24 of the component 20. For example, if the component is made of Nylon 6, 33% glass filled, the component 20 typically has a melt temperature of 215° C. In such cases the damping layer 34 is formed of zinc as opposed to aluminum since zinc has a melting temperature of 420° C. Alternatively, other type of metals that can be thermally sprayed to form the damping layer 34. Further, more than one metal can be simultaneously sprayed to form the damping layer 34. Preferably, the thickness of the damping layer 34 is in the range of about 0.5 mm to 4.0 mm.

Figure 5:
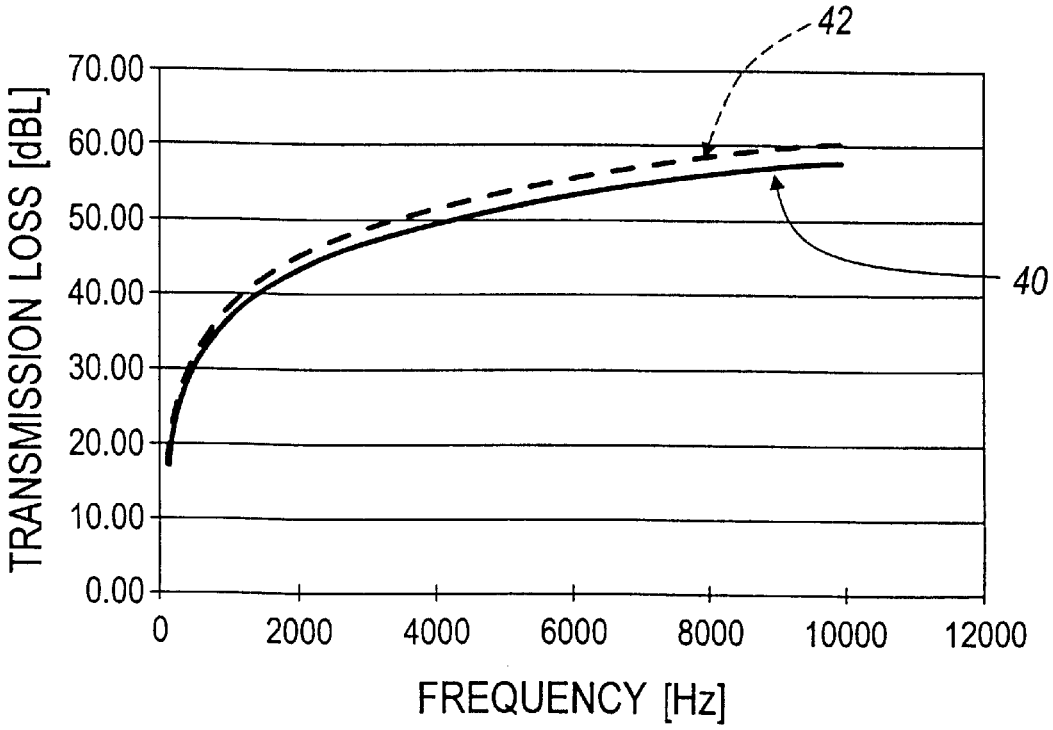
FIG. 5 is a graphical representation of the transmission loss through the exterior surface of the component.

As shown in FIG. 5, the transmission loss of the component 20 was measured using the basic rule of acoustics, called the mass law. This law states that most panels, when properly designed, will transmit noise nearly equivalent to the inverse of their material thickness. The rule essentially states, the thicker the part, the less noise transmission. As shown in the graph, a component 20 with a 1 mm coating of damping layer 34 made of zinc (represented by reference numeral 40) had greater transmission loss than the component 20 with a 4 mm damping layer 34 made of aluminum (represented by reference numeral 42).

In order to test the NVH properties of the component 20, the testing was conducted to measure the noise emitted from the component 20. Testing was conducted in a hemi-anechoic chamber to eliminate background noise. Flow noise was ducted through each set of components 20 to set up high frequency oscillations within the interior of each part. A microphone was placed at a distance of 100 mm from the surface of the part and recordings were taken for the following components: Aluminum component, Nylon 6, 33% glass filled component with no coating, Nylon 6, 33% glass filled component with a 4 mm coating of aluminum damping layer 34.

Figure 6:
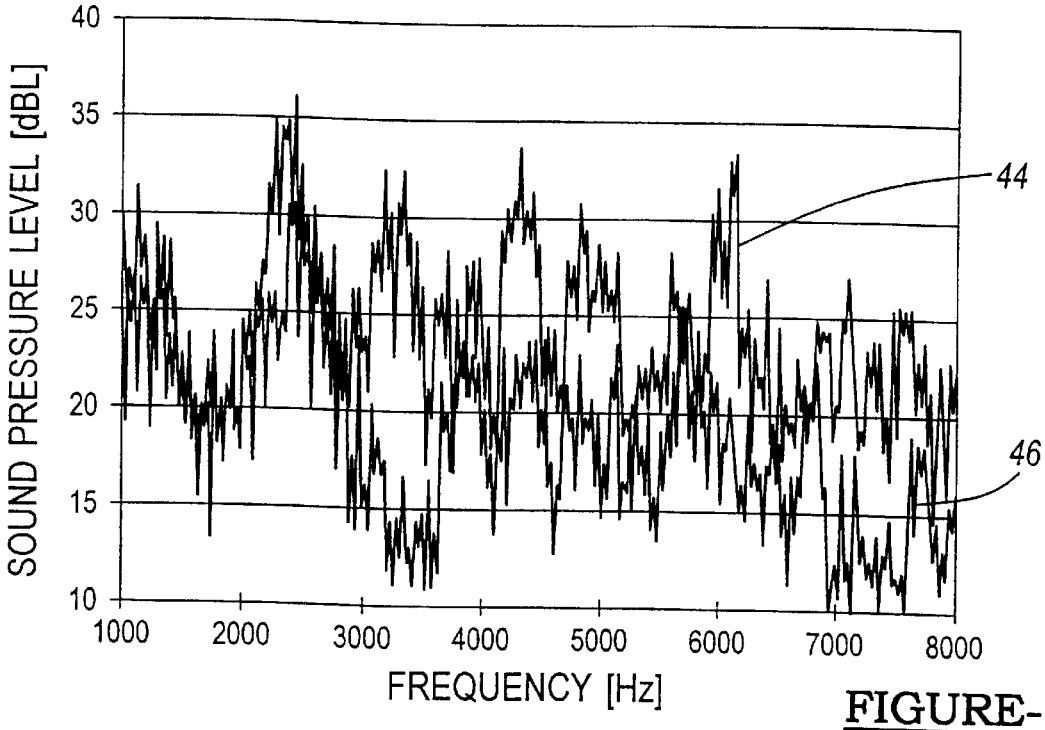
FIG. 6 is a graphical representation of frequency versus sound pressure level for a aluminum component and a composite component.
Figure 7:
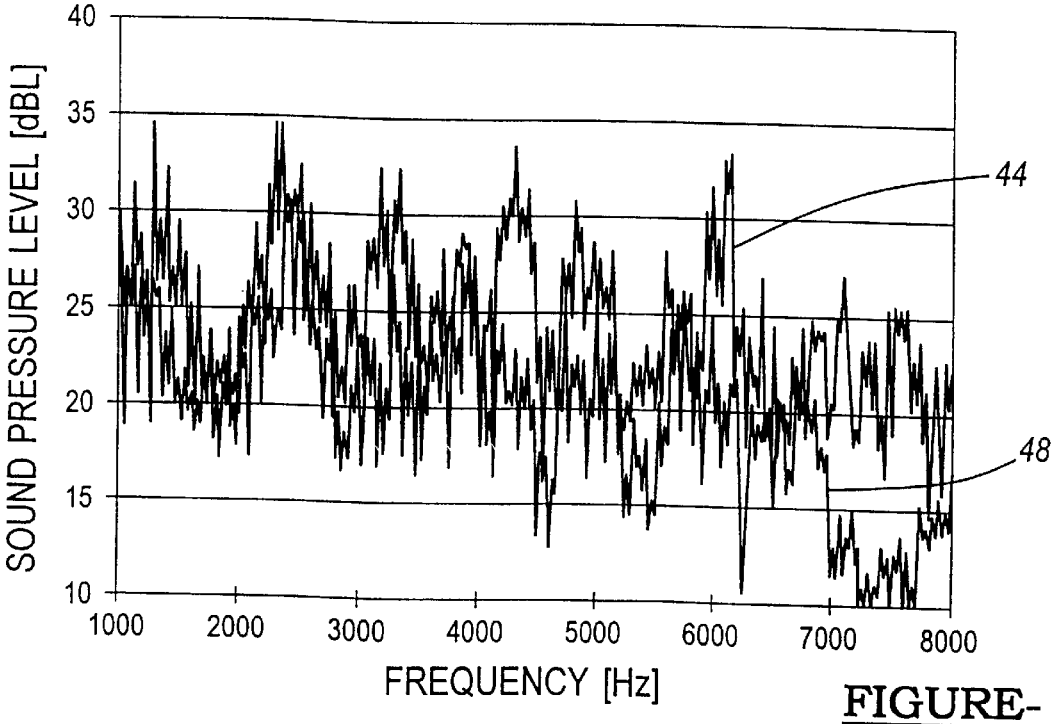
FIG. 7 is a graphical representation of frequency versus sound pressure level for a composite component and the composite component with a damping layer.

The test results are indicated in FIGS. 6 and 7. As shown in FIG. 6, the Nylon 6, 33% glass filled component has a higher level of radiated noise (represented by reference numeral 44) than the aluminum component (represented by reference numeral 46) across the frequency spectrum. However, in FIG. 5 the radiated noise is substantially reduced when the Nylon 6, 33% glass filled component is compared with the Nylon 6, 33% glass filled component with a damping layer 34 (represented by reference numeral 48). As seen above, the present invention provides for selectively applying the damping layer 34 to an exterior surface of a component 20 such that the component has improved NVH properties.

As any person skilled in the art will recognize from the previous description and from the figures and claims, modifications and changes can be made to the preferred embodiment of the invention without departing from the scope of the invention as defined in the following claims.

What is claimed is:

1. A component for an internal combustion engine of an automobile having reduced NVH properties, the component comprising:

a shell formed with a plastic composite material defining an inlet port, an outlet port, an outer surface and an inner surface, the inner surface defining an inner cavity to allow air passage to the internal combustion engine; and a metallic damping layer coated on the outer surface, wherein the metallic damping layer substantially dampens the noise emitted from the component.

2. The component of claim 1, wherein the shell comprises a first section, a second section and a flange section extending from the outer surface of the component.

3. The component of claim 2, wherein the first section and the second section are joined at the flange section with the help of fasteners to form the component.

4. The component of claim 2, wherein the flange section is free of the metallic damping layer.

5. The component of claim 1, wherein the composite plastic material is selected from a group consisting of Nylon 6, 30% glass filled, Nylon 6, 33% glass filled, Nylon 6,6, 30% glass filled, Nylon 6,6, 33% glass filled or Nylon 6, 6, 35% glass filled.

6. The component of claim 1, wherein the metallic damping layer is formed of a metal selected from a group consisting of zinc or aluminum.

7. The component of claim 1, wherein the thickness of the metallic damping layer is in the range of 0.5 mm to 4.0 mm.

8. The component of claim 1, wherein the inlet port is connectable to a throttle chamber.

9. The component of claim 1, wherein the outlet port is connectable to an intake manifold of the internal combustion engine.

10. The method of manufacturing a component for an internal combustion engine in an automobile having reduced NVH properties, the method comprising:

providing a shell defining an inlet port, an outlet port, an outer surface and an inner surface;

forming the shell from a plastic composite material;

masking a portion of the outer surface such that the outer surface defines an unmasked portion; and applying a metallic damping layer to the unmasked portion to dampen noise emitted from the component.

11. The method of claim 10, further comprising the shell having a first section, a second section and a flange section extending from the outer surface of the component.

12. The method of claim 11, further comprising the step of joining the first section and the second section at the flange section with the help of fasteners.

13. The method of claim 11, further comprising the step of masking the flange portion such that the flange portion is free of the metallic damping layer.

14. The method of claim 10, comprising selecting the plastic composite material from a group consisting of Nylon 6, 30% glass filled, Nylon 6, 33% glass filled, Nylon 6,6, 30% glass filled, Nylon 6,6, 33% glass filled or Nylon 6, 6, 35% glass filled.

15. The method of claim 10, comprising applying the metallic damping layer further comprising the step of coating the outer surface with a metallic material.

16. The method of claim 15, comprising selecting the metallic material from a group consisting of zinc or aluminum.

17. The method of claim 10, comprising applying the metallic damping layer having a thickness in the range of 0.5 mm to 4.0 mm.

18. The method of claim 10, further comprising the step of connecting the inlet port to a throttle chamber.

19. The method of claim 10, further comprising the step of connecting the outlet port to a manifold of the internal combustion engine.

20. The method of claim 10, comprising the inner surface defining an internal cavity to allow air passage to the internal combustion engine.

* * * * *